US005611528A

United States Patent [19]

Nakamura et al.

[11] Patent Number: 5,611,528

[45] Date of Patent: Mar. 18, 1997

[54] IMAGE-FORMING MACHINE EQUIPPED WITH A CASSETTE FOR FEEDING SHEET MATERIALS

[75] Inventors: Toshiyuki Nakamura; Toshio Hori, both of Osaka, Japan

[73] Assignee: Mita Industrial Company, Ltd., Osaka, Japan

[21] Appl. No.: 371,154

[22] Filed: Jan. 11, 1995

[30] Foreign Application Priority Data

Jan. 14, 1994 [JP] Japan ..... 6-002359

[51] Int. Cl.[6] ..... B65H 1/04; B65H 1/12

[52] U.S. Cl. ..... 271/164; 271/171

[58] Field of Search ..... 271/162, 164, 271/171

[56] References Cited

U.S. PATENT DOCUMENTS

| | | | |
|---|---|---|---|
| 4,660,823 | 4/1987 | Sato | 271/164 X |
| 4,874,160 | 10/1989 | Yamamoto | 271/171 X |
| 5,215,303 | 6/1993 | Yamada et al. | 271/171 X |
| 5,294,106 | 3/1994 | Takagi et al. | 271/162 X |
| 5,320,338 | 6/1994 | Shinohara et al. | 271/164 |
| 5,332,208 | 7/1994 | Tsuji et al. | 271/171 |
| 5,332,209 | 7/1994 | Romansky et al. | 271/171 |

*Primary Examiner*—David A. Bucci
*Assistant Examiner*—Scott L. Lowe
*Attorney, Agent, or Firm*—Antonelli, Terry, Stout & Kraus, LLP

[57] ABSTRACT

An image-forming machine comprising a cassette for feeding sheet materials that moves between an acting position and a drawn position which is forwardly drawn from the acting position in the housing of the image-forming machine. Provision is made of a locking mechanism which reliably locks at a preset position a front width restriction member and a rear width restriction member of the cassette for feeding sheet materials. The locking mechanism includes a locking member, a resilient urging member and a forcing means. When the cassette for feeding sheet materials is at the drawn position, the resilient urging member urges the locking member to the release position and when the cassette for feeding sheet materials is moved toward the acting position, the forcing member forces the locking member to the locking position to lock the front width restriction member and the rear width restriction member.

5 Claims, 6 Drawing Sheets

IMAGE-FORMING MACHINE EQUIPPED WITH A CASSETTE FOR FEEDING SHEET MATERIALS

FIELD OF THE INVENTION

The present invention relates to an image-forming machine. More particularly, the invention relates to an image-forming machine equipped with a housing and a cassette for feeding sheet materials loaded in the housing so as to move in the back-and-forth direction between an acting position and a drawn position that is drawn forward from the acting position in the housing.

DESCRIPTION OF THE PRIOR ART

In image-forming machines such as electrostatic copying machines and electrostatic printers, there is generally used a cassette for feeding sheet materials such as common paper and the like paper on which an image will be formed. The cassettes for feeding sheet materials that are widely put into practical use in recent years are those of the so-called "front-loading type" that are loaded in the housing of the image-forming machine to freely move in the back-and-forth direction between a predetermined acting position and a drawn position that is drawn forward from the acting position and further are those of the so-called "universal type" adapted for holding sheet materials of various sizes. The cassette for feeding sheet materials of the universal type includes a container body, a front width restriction means and a rear width restriction means which are so disposed in the container body as to freely move in the back-and-forth direction. The front width restriction means has a bottom wall with a rearwardly extended portion and an upright restriction wall that upwardly extends from the bottom wall, and the rear width restriction means has a bottom wall with a forwardly extended portion and an upright restriction wall that upwardly extends from the bottom wall. The container body has a rotary pinion gear that is located between the extended portion of the front width restriction means and the extended portion of the rear width restriction means that are extending in parallel with each other. Racks that will be brought into engagement with the above pinion gear are engraved in the extended portion of the front width restriction means and in the extended portion of the rear width restriction means. Therefore, when the front width restriction means is moved backward or forward by a required distance, the rear width restriction means is interlockingly moved forward or backward by the same distance. The front width restriction means and the rear width restriction means each have a pawl member that will be brought into engagement with a front corner portion of a sheet material at the highest position on the sheet materials that are usually contained in a stacked state. The container body further has a rear end restriction means that can be moved in the right-and-left direction.

In the image-forming machine equipped with the above-mentioned cassette for feeding sheet materials, the cassette for feeding sheet materials is drawn to the drawn position and plural pieces of sheet materials are contained in the container body in a stacked manner. The front width restriction means and the rear width restriction means are so positioned as to correspond to the width of the sheet materials that are held in a space between the upright restriction walls thereof, and the rear end restriction means is so positioned that the distance from the front end wall of the container body corresponds to the length of the sheet materials in a direction in which they will be delivered. When the sheet material-feeding cassette containing the sheet members is moved to the acting position in the housing, a delivery means provided in the housing acts upon the sheet material and separates the sheet materials one piece by one piece in cooperation with the pawl member to deliver the sheet materials toward the right or the left.

When drawn to the drawn position, the front width restriction means and the rear width restriction means of the cassette for feeding sheet materials of the above-mentioned form must be moved very easily in the back-and-forth direction depending upon the width of the sheet materials to be contained, and must be held at the predetermined position very reliably after they are once set to such predetermined position. In the case of the cassette for feeding sheet materials of the front-loading type, however, there is a tendency that the motion of the cassette for feeding sheet materials is abruptly stopped in a final stage in which it is moved from the drawn position to the acting position, causing considerable impact to be given from the sheet materials to the front width restriction means and to the rear width restriction means and, particularly, to the rear width restriction means. The conventional image-forming machines are accompanied by a problem in that the above impact causes the front width restriction means and the rear width restriction means to move or vibrate in the back-and-forth direction. When the front width restriction means and the rear width restriction means are moved or vibrated in the back-and-forth direction, the uppermost sheet material or a few pieces of sheet materials from the uppermost one inclusive of the uppermost one among the plural pieces of sheet materials contained in the container body are liberated from the pawl member and are caused to be positioned over the pawl member resulting in the occurrence of such events that two or more pieces of sheet materials are delivered at one time, the sheet material to be delivered is greatly tilted, or the sheet material is not successfully delivered.

SUMMARY OF THE INVENTION

It is a principal object of the present invention to provide an improved image-forming machine which, when the cassette for feeding sheet materials is located at a drawn position, permits a front width restriction means and a rear width restriction means to be moved very easily in the back-and-forth direction as required and which reliably prevents the front width restriction means and the rear width restriction means from moving or vibrating in the back-and-forth direction even when considerably large impact is given to the front width restriction means and to the rear width restriction means and, particularly, to the rear width restriction means in a final stage in which the cassette for feeding sheet materials is moved from the drawn position to the acting position.

In order to accomplish the above-mentioned principal object, according to the present invention there is provided a locking mechanism which includes a locking member and a resilient urging means that are disposed in a container body of the cassette for feeding sheet materials and a forcing means disposed in a housing, wherein the locking member is disposed to move between a locking position at which it is brought into engagement with either an extended portion of the front width restriction means or an extended portion of the rear width restriction means and a release position at which it is liberated from either the extended portion of the front width restriction means or the protruded portion of the rear width restriction means, the resilient urging means resiliently urges the locking member to the release position, and, when the cassette for feeding sheet materials is rearwardly moved from the drawn position toward the acting position beyond a predetermined position, the forcing means acts upon the locking member to force the locking member to the locking position overcoming the resilient urging means.

In order to accomplish the above-mentioned principal technical assignment, the present invention provides an image-forming machine comprising a housing and a cassette for feeding sheet materials which is loaded in the housing so as to move in the back-and-forth direction between an acting position and a drawn position that is forwardly drawn from the acting position in the housing, wherein the cassette for feeding sheet materials includes a container body, a front width restriction means and a rear width restriction means which are so disposed in the container body as to move in the back-and-forth direction, the front width restriction means has a bottom wall with a rearwardly extended portion and an upright restriction wall that upwardly extends from the bottom wall, the rear width restriction means has a bottom wall with a forwardly extended portion and an upright restriction wall that upwardly extends from the bottom wall, the container body has a rotary pinion gear that is disposed between the extended portion of the front width restriction means and the extended portion of the rear width restriction means that are extending in parallel with each other, and racks that are brought into engagement with the pinion gear are engraved in the extended portion of the front width restriction means and in the extended portion of the rear width restriction means, characterized in that the image-forming machine further comprises a locking mechanism which includes a locking member and a resilient urging means that are disposed in the container body of the cassette for feeding sheet materials, and a forcing means disposed in the housing, and in that the locking member is disposed to move between a locking position at which it is brought into engagement with either the extended portion of the front width restriction means or the extended portion of the rear width restriction means and a release position at which it is liberated from either the extended portion of the front width restriction means or the extended portion of the rear width restriction means, the resilient urging means resiliently urges the locking member to the release position, and when the cassette for feeding sheet materials is rearwardly moved from the drawn position toward the acting position beyond a predetermined position, the forcing means acts upon the locking member to force the locking member to the locking position overcoming the resilient urging means.

It is desired that a to-be-engaged portion is formed on the extended portion of the rear width restriction means and that an engaging portion is formed on the locking member so as to be brought into engagement with the to-be-engaged portion. The locking member is made of a synthetic resin and, when the forcing means acts on the locking member to force the locking member to the locking position, the locking member is resiliently brought into engagement with either the extended portion of the front width restriction means or the extended portion of the rear width restriction means due to the resilient deformation of the locking member itself. It is further desired that the locking member is disposed being opposed to the pinion gear via either the extended portion of the front width restriction means or the extended portion of the rear width restriction means and that when the locking member is forced to the locking position, the rack formed in either the extended portion of the front width restriction means or the extended portion of the rear width restriction means is pushed onto the pinion gear. It is desired that the cassette for feeding sheet materials further includes a placing plate that is pivotably mounted in the container body and a resilient urging means which upwardly and resiliently urges a tip portion of the placing plate, and that the locking member has a placing plate-locking piece, the placing plate has a to-be-locked piece, and when the tip portion of the placing plate is lowered against the urging action of the resilient urging means while the locking member is located at the release position, the to-be-locked piece of the placing plate is brought into engagement with the locking piece of the placing plate so that the tip portion of the placing plate is locked at a descended position and when the locking member is forced to the locking position, the to-be-locked piece of the placing plate is liberated from the placing plate-locking piece.

In the image-forming machine improved according to the present invention, when the cassette for feeding sheet materials is drawn to the drawn position, the locking member is located at the release position due to the urging action of the resilient urging means. As required, therefore, the front width restriction means and the rear width restriction means can be moved very easily in the back-and-forth direction. When the cassette for feeding sheet materials is rearwardy moved from the drawn position to the acting position beyond a predetermined position, the forcing means acts upon the locking member and forces the locking member to the acting position overcoming the urging action of the resilient urging means. The locking member forced to the acting position is brought into engagement with either the extruded portion of the front width restriction means or the extruded portion of the rear width restriction means in order to lock the movement of the front width restriction means or the rear width restriction means in the back-and-forth direction as well as to lock the movement of the rear width restriction means or the front width restriction means in the back-and-forth direction via the rack formed in the extruded portion of the front width restriction means or the rear width restriction means, via the pinion gear and via the rack formed in the extruded portion of the rear width restriction member or the front width restriction member.

DETAILED DESCRIPTION OF THE PREFERRED EMBODIMENTS

Preferred embodiments of the image-forming machine improved according to the present invention will now be described in detail with reference to the accompanying drawings.

Figure 1:
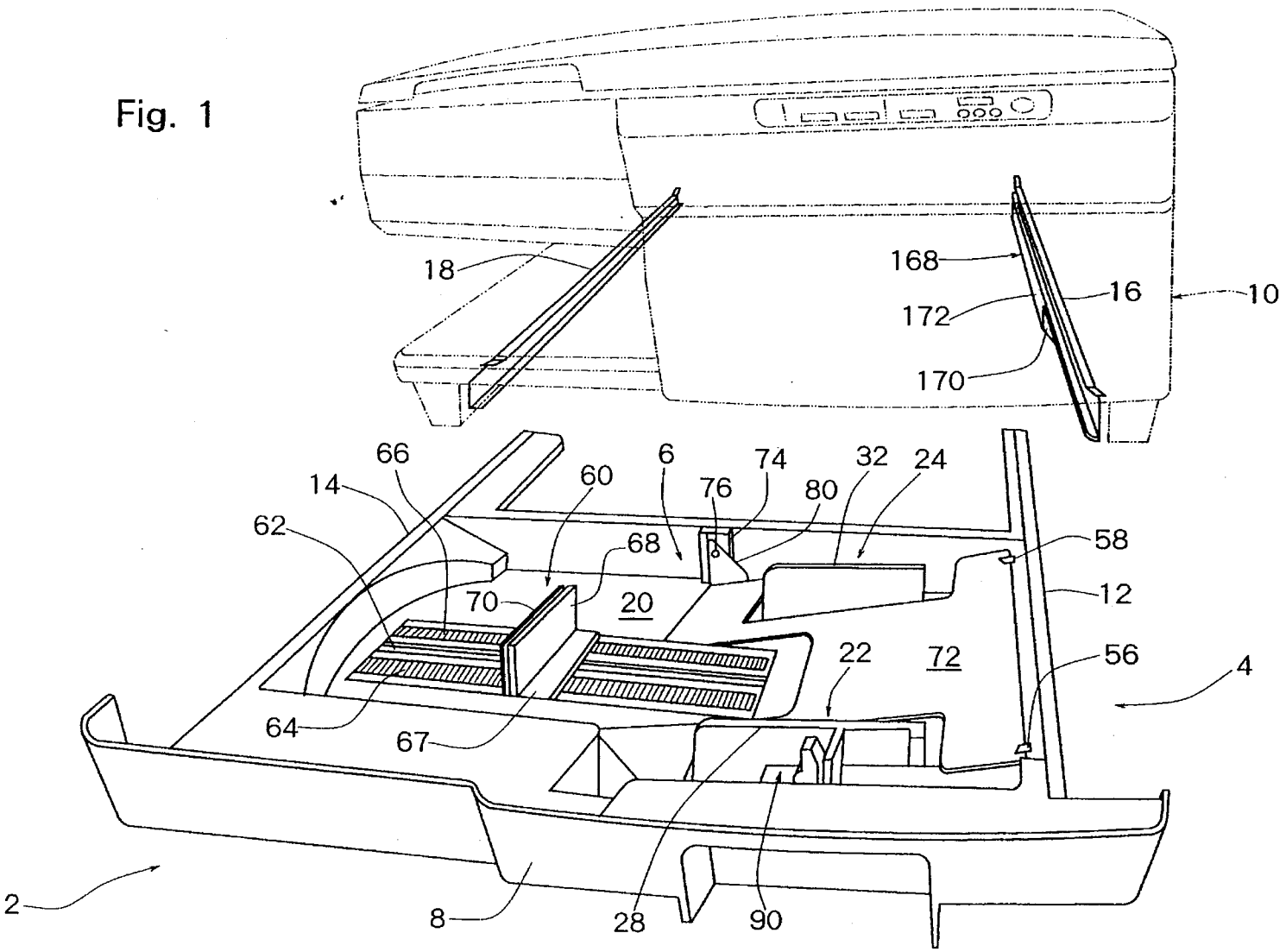
FIG. 1 is a perspective view illustrating a preferred embodiment of a cassette for feeding sheet materials constituted according to the present invention together with a housing of an image-forming machine to which the cassette for feeding sheet materials is adapted.
Figure 2:
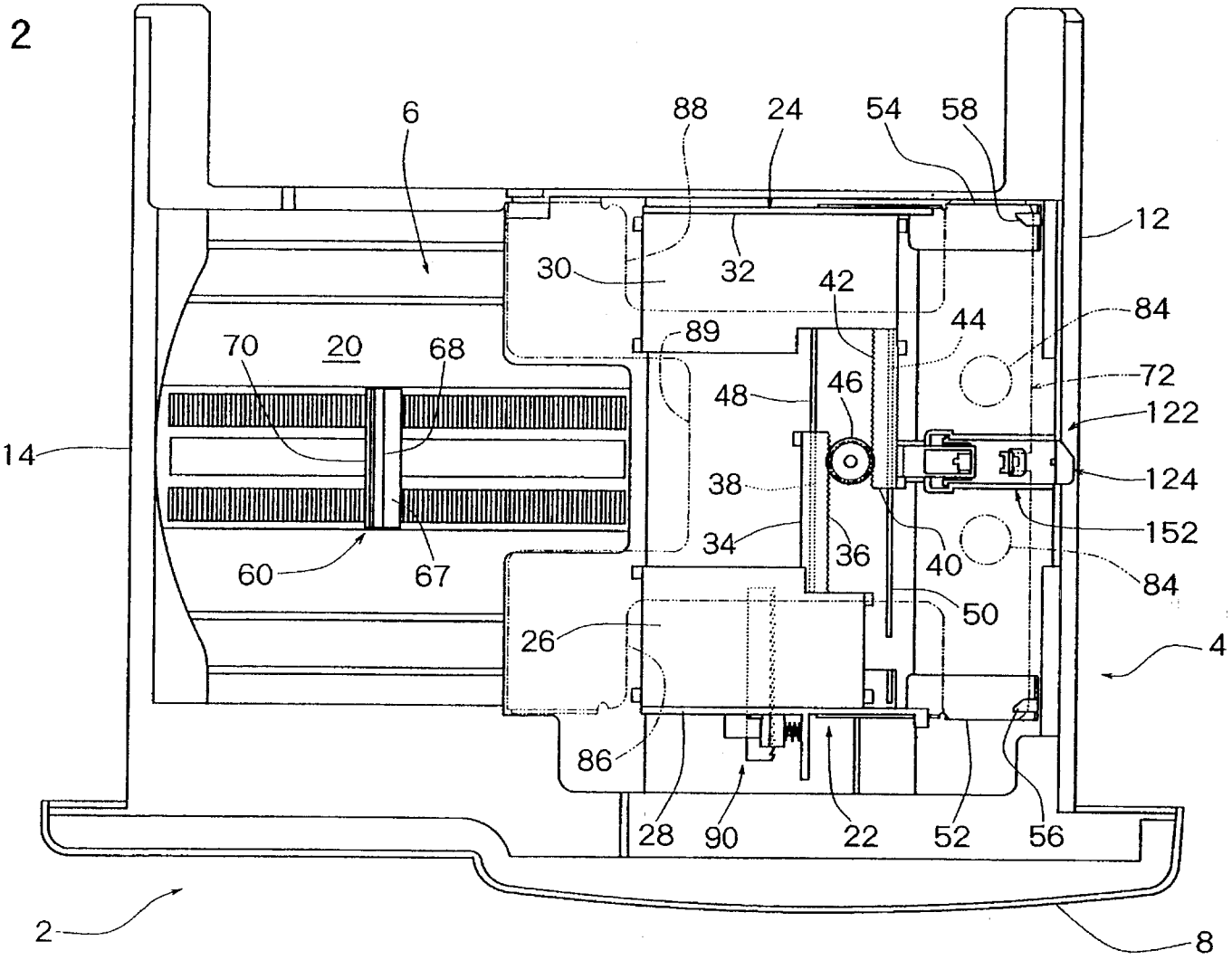
FIG. 2 is a plan view of the cassette for feeding sheet materials shown in FIG. 1.

With reference to FIGS. 1 and 2, an image-forming machine such as an electrostatic copying machine or an electrostatic printer is equipped with a housing 10 and a cassette 2 for feeding sheet materials. The cassette 2 for feeding sheet materials includes a container body 4 that can be made of a suitable synthetic resin. The container body 4 has a box-like main portion 6 of which the upper surface is opened. A front-edge frame 8 is formed at the front edge of the main portion 6. The front-edge frame 8 constitutes a grip portion which can be held by an operator when the cassette 2 for feeding sheet materials loaded in the housing 10 is moved in the back-and-forth direction (up-and-down direction in FIG. 2) in a manner as will be described later and further constitutes a part of the decorated outer frame on the front surface of the housing 10 when the cassette for feeding sheet materials is located at a predetermined acting position in the housing 10. At both side edges (right and left side edges) of the container body 4 are formed to-be-guided rails 12 and 14 that extend rearwardly beyond the main portion 6. As clearly shown in FIG. 3, the to-be-guided rails 12 and 14 may have the shape of an inverted channel having open lower surfaces. As indicated by FIG. 1, the housing 10 to which the cassette 2 for feeding sheet materials is adapted is provided with a pair of stationary guide rails 16 and 18 that extend substantially horizontally and rearwardly from the open front surface. The to-be-guided rails 12 and 14 are brought into engagement with the guide rails 16 and 18, so that the cassette 2 for feeding sheet materials is loaded in the housing 10 to move in the back-and-forth direction between a predetermined acting position and a drawn position which is forwardly drawn from the acting position.

With reference to FIGS. 1 and 2, a bottom wall member 20 that is separately molded is fastened to the bottom surface of the container body 4. If desired, the bottom wall member 20 defining the bottom wall of the container body 4 may be formed integrally with the container body 4. On the right half of the bottom wall member 20 are mounted a pair of width restriction means, i.e., a front width restriction means 22 and a rear width restriction means 24 to move in the back-and-forth direction (up-and-down direction in FIG. 2). The front width restriction means 22 has a bottom wall 26 and an upright restriction wall 28 that upwardly extends substantially vertically from the front edge of the bottom wall 26. The rear width restriction means 24 has a bottom wall 30 and an upright restriction wall 32 that upwardly extends substantially vertically from the rear edge of the bottom wall 30. A rearwardly extended portion 34 is formed on the bottom wall 26 of the front width restriction means 22. A rack 36 is engraved in the right side surface of the extended portion 34. A to-be-guided groove 38 extending in the back-and-forth direction is formed in the lower surface of the extended portion 34. The lower surface of the extended portion 34 downwardly protrudes beyond the lower surface of the main portion of the bottom wall 26, and the bottom surface of the to-be-guided groove 38 formed in the extended portion 34 is flush with the lower surface of the main portion of the bottom wall 26. Similarly, a forwardly extruded portion 40 is formed on the bottom wall 30 of the rear width restriction means 24. A rack 42 is engraved in the left side surface of the extruded portion 40. A to-be-guided groove 44 is formed in the lower surface of the extended portion 40 extending in the back-and-forth direction. The lower surface of the extended portion 40 downwardly protrudes beyond the lower surface of the main portion of the bottom wall 30, and the bottom surface of the to-be-guided groove 44 formed in the extended portion 40 is flush with the lower surface of the main portion of the bottom wall 30. A pinion gear 46 is mounted on the upper surface of the bottom wall member 20 at a central portion in the back-and-forth direction, the pinion gear 46 being allowed to rotate on a center axis that extends substantially vertically. Guide protrusions 48 and 50 extending in the back-and-forth direction are formed on both the right and left sides of the pinion gear 46. The front width restriction means 22 has its to-be-guided groove 38 formed in the lower surface of the extended portion 34 engaged with the guide protrusion 48, has its rack 36 formed in the right side surface of the extended portion 34 engaged with the pinion gear 46, and is mounted on the bottom wall member 20. The rear width restriction means 24 has its to-be-guided groove 44 formed in the lower surface of the extended portion 40 engaged with the guide protrusion 50, has its rack 42 formed in the left side surface of the extended portion 40 engaged with the pinion gear 46, and is mounted on the bottom wall member 20. Thus, both the front width restriction means 22 and the rear width restriction means 24 are mounted on the bottom wall member 20 to move in the back-and-forth direction, and movements of the front width restriction means 22 and of the rear width restriction means 24 in the back-and-forth direction are interlocked with each other via racks 36, 42 and pinion gear 46. When the front width restriction member 22 is rearwardly moved by a predetermined distance, the rear width restriction member 24 is interlockingly forwardly moved by the same distance. When the front width restriction member 22 is forwardly moved by a predetermined distance, the rear width restriction member 24 is interlockingly rearwardly moved by the same distance.

The front width restriction means 22 and the rear width restriction means 24 are provided with pawl members 52 and 54 which may be of a known form. The pawl members 52 and 54 which are preferably made of a suitable metal plate are mounted on the upright restriction walls 28 and 32 of the front width restriction means 22 and of the rear width restriction means 24 being allowed to turn over some range of angles on the center axes that extend substantially horizontally. The pawl members 52 and 54 have separation pawls 56 and 58 disposed on the upper surfaces at the tip portions (right ends) thereof.

With reference to FIGS. 1 and 2, on the left half portion of the bottom wall member 20 is mounted a rear end restriction means 60 that moves in the back-and-forth direction. In the left half portion of the bottom wall member 20 is formed an elongated slit 62 extending in the right-and-left direction. Stationary engaging means 64 and 66 constituted by many alternately formed recesses and protrusions are arranged on the upper surface of the bottom wall member 20 on the front side and back side of the slit 62. The rear end restriction means 60 which can be made of a suitable synthetic resin has a bottom wall 67 and an upright restriction wall 68 that upwardly extends substantially vertically from the bottom wall 67. A mounting arm (not shown) is formed on the lower surface of the bottom wall 67. The mounting arm is resiliently deformed and is brought into engagement with the lower surface of the bottom member 20 through the slit 62, so that the rear end restriction means 60 is mounted on the bottom wall member 20 to move in the right-and-left direction along the slit 62. On the rear end restriction means 60 is further formed an operation piece 70 that upwardly protrudes from the rear end of the bottom wall 67 as well as an engaging protrusion (not shown) that downwardly protrudes from the rear end of the lower surface of the bottom wall 67. The engaging protrusion is brought into engagement with the recesses and protrusions of the stationary engaging means 64 and 66 on both sides of the slit 62, whereby the rear end restriction means 60 is locked to a preset position. To change the preset position of the rear end restriction means 60, the upright restriction wall 68 and the operation piece 70 are pressed by fingers, the operation piece 70 is resiliently deformed in such a direction that the upper end thereof is brought close to, or is brought into contact with, the upright restriction wall 68, so that the rear end of the bottom wall 67 is resiliently deformed upwardly to some extent. Thus, the engaging protrusion formed at the rear end of the lower surface of the bottom wall 67 is separated away from the stationary engaging means 64 and 66. Under this state, the rear end restriction means 60 is moved to a desired position along the slit 62 and, then, the operation piece 70 is liberated so that it resiliently returns to its initial state. The engaging protrusion formed at the rear end of the lower surface of the bottom wall 67 is then allowed to come into engagement again with the stationary engaging means 64 and 66.

Figure 3:
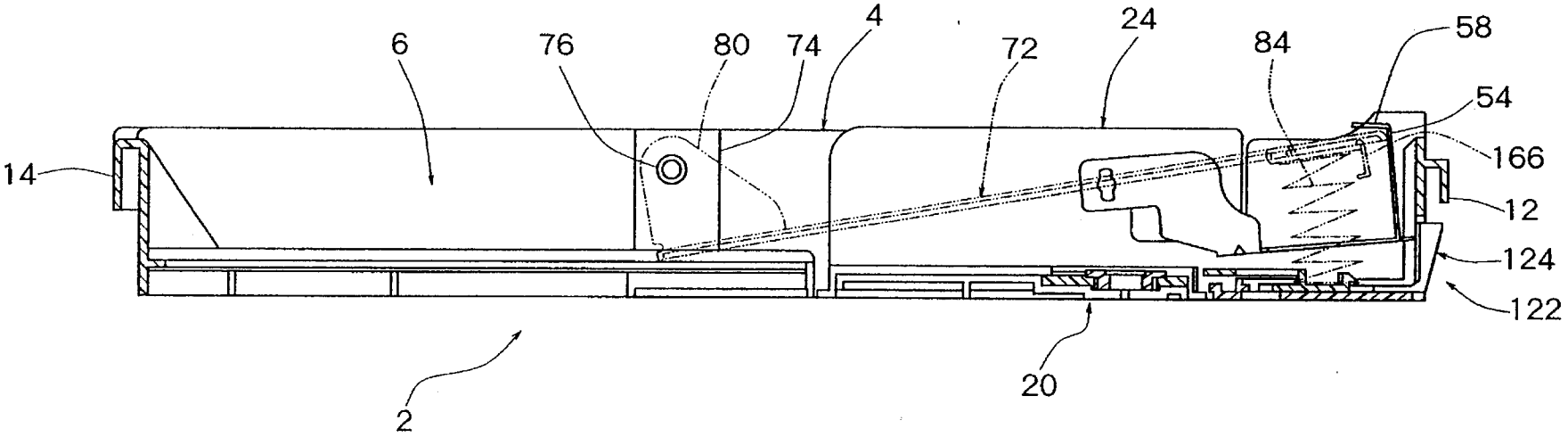
FIG. 3 is a sectional view of the cassette for feeding sheet materials shown in FIG. 1.

Referring to FIG. 3 together with FIGS. 1 and 2, a placing plate 72 is mounted on the main portion 6 of the container body 4. On the bottom wall member 20 are formed mounting pieces 74 that upwardly protrude substantially vertically from the front edge and the rear edge thereof nearly at the center in the right-and-left direction. On the mounting pieces 74 are formed short shafts 76 that protrude forwardly and rearwardly. The placing plate 72 that can be made of a suitable metal plate has protruded pieces 80 that upwardly protrude from both side edges at the left end thereof. The protruded pieces 80 of the placing plate 72 are pivotably fitted to the short shafts 76 formed on the mounting pieces 74. A resilient urging means 84 is disposed between the bottom wall member 20 and the placing plate 72 at the right end of the container body 4. The resilient urging means 84 constituted by a pair of compression coil springs urges the right end portion of the placing plate 72 upwardly and resiliently. Thus, both corners at the right end of the placing plate 72 or of the sheet material placed thereon are pushed to the separation pawls 56 and 58. Relatively large cut-away portions 86 and 88 are formed in the placing plate 72 on the front side and the rear side at the center in the right-and-left direction. The upright restriction wall 28 of the front width restriction means 22 and the upright restriction wall 32 of the rear width restriction means 24 protrude upwardly passing through the cut-away portions 86 and 88 of the placing plate 72. A relatively large cut-away portion 89 is further formed in the left end portion of the placing plate 72, and the rear end restriction means 60 is allowed to move into the cut-away portion 89.

In the above-mentioned cassette 2 for feeding sheet materials, the front width restriction means 22 and the rear width restriction means 24 are located at such positions that the distance between the upright restriction walls 28 and 32 thereof corresponds to the width of the sheet materials that are to be contained, and the rear end restriction means 60 is located at such a position that the distance from the upright restriction wall 68 thereof to the right end of the bottom wall member 20 corresponds to the length of the sheet materials to be contained in the direction in which they will be delivered. Then, plural pieces of sheet materials that are stacked are placed with their front half portions in the direction of delivery on the placing plate 72, and are contained in the container body 4. Being urged by the resilient urging means 84, both corners at the front end of the uppermost sheet material is pushed onto the separation pawls 56 and 58. When the cassette 2 for feeding sheet materials is inserted in the housing 10 up to the predetermined acting position, a delivery means (not shown) such as a roller or an endless belt selectively acts on the uppermost sheet material to deliver the sheet material toward the right in FIGS. 2 and 3.

The above-mentioned constitution related to the illustrated cassette 2 for feeding sheet materials is not concerned with the novel constitution improved according to the present invention, but simply shows the typical constitution of the cassette for feeding sheet materials in the image-forming machine to which the present invention is adapted. Therefore, the above-mentioned constitution is not described in further detail in this specification.

Figure 4:
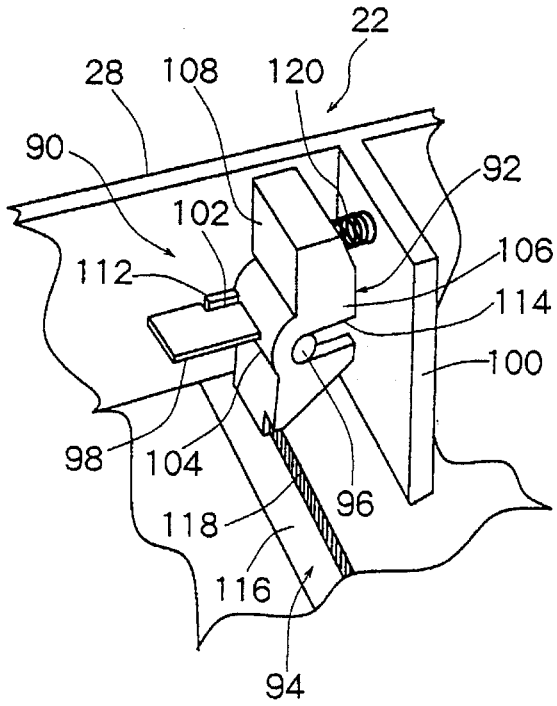
FIG. 4 is a perspective view illustrating a portion of a locking mechanism that is provided in relation to a front width restriction means in the cassette for feeding sheet materials shown in FIG. 1.
Figure 5:
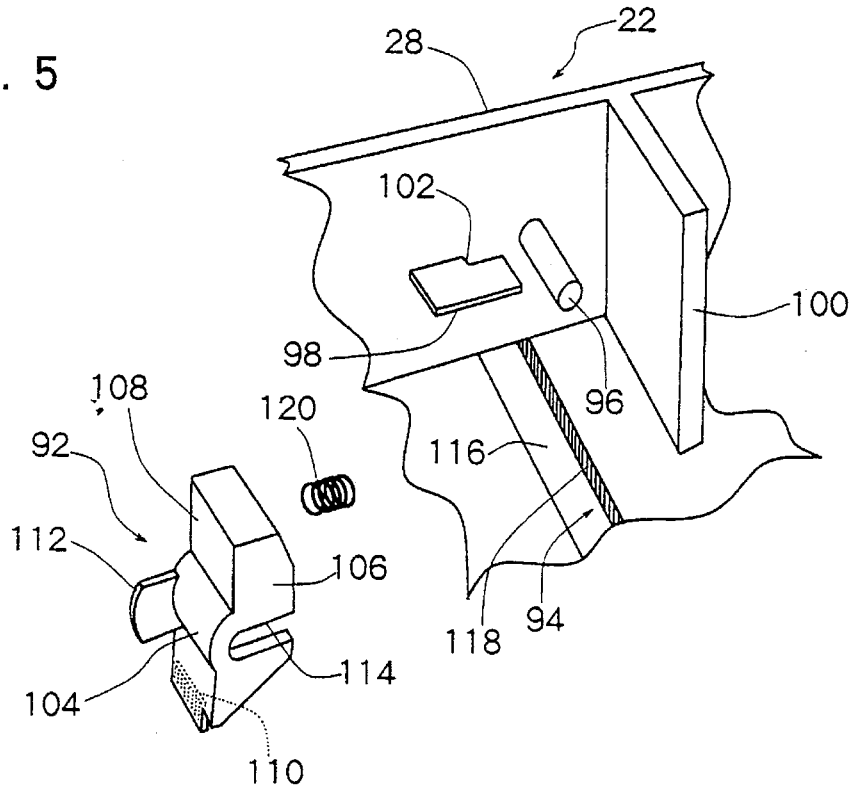
FIG. 5 is a perspective view illustrating, in a dissembled manner, a portion of the locking mechanism that is provided in relation to the front width restriction means in the cassette for feeding sheet materials shown in FIG. 1.

With reference to FIGS. 4 and 5 together with FIGS. 1 and 2, the illustrated cassette 2 for feeding sheet materials is provided with a locking mechanism 90 for locking the front width restriction means 22 at a preset position. The locking mechanism 90 is constituted by an engaging member 92 fitted to the outer surface, i.e., front surface, (lower surface in FIG. 1) of the upright restriction wall 28 of the front width restriction means 22, and a stationary to-be-engaged means 94 formed on the bottom wall member 20. As clearly shown in FIG. 5, a support shaft 96 that forwardly protrudes substantially horizontally is integrally formed on the front surface of the upright restriction wall 28 of the front width restriction means 22. On the front surface of the upright restriction wall 28 are further integrally formed a locking piece 98 on the left side of the support shaft 96 and a receiving piece 100 on the right side of the support shaft 96. The locking piece 98 extends substantially horizontally from the front surface of the upright restriction wall 28 and the receiving piece 100 extends substantially vertically from the front surface of the upright restriction wall 28. In the locking piece 98 is formed an insertion notch 102 which neighbors the front surface of the upright restriction wall 28 and leftwardly extends along the upright restriction wall 28 from the side facing the support shaft 96. The engaging member 92 that can be made of a suitable synthetic resin has a main wall portion 104 that extends in the up-and-down direction and a pair of protruded wall portions 106 that rearwardly protrude from the front edge and rear edge on the right side of the main wall portion 104. The intermediate portion of the main wall portion 104 in the up-and-down direction is formed in an arcuate shape. The left surface at the upper end of the main wall portion 104 constitutes a finger-touch surface 108 which can be touched by a finger of the operator. On the right surface at the lower end of the main wall portion 104 is formed an engaging portion 110 constituted by grooves and protrusions that are alternately arranged in the back-and-forth direction. On the main wall portion 104 is further formed a to-be-locked protrusion 112 that leftwardly protrudes from the rear edge thereof at an intermediate position in the up-and-down direction. The to-be-locked protrusion 112 extends nearly in a fan shape over a range of angles which may be about 45 degrees with the support shaft 96 on which the engaging member 92 is pivotably mounted as a center. An elongated mounting notch 114 that is open at the right end is formed in a pair of protruded wall portions 106 of the engaging member 92. The left end of the mounting notch 114 is in a semicircular shape. A groove 116 extending in the back-and-forth direction is formed in the upper surface of the bottom wall member 20, and the stationary to-be-engaged means 94 is disposed on the right surface of the groove 116. The stationary to-be-engaged means 94 has many to-be-engaged portions 118 constituted by many grooves and protrusions that are alternately arranged in the back-and-forth direction.

With reference to FIGS. 4 and 5, the to-be-locked protrusion 112 of the engaging member 92 is held at an angular position that is not interfered by the locking piece 98 formed on the upright restriction wall 28, the main wall portion 104 of the engaging member 92 is positioned on the right side of the locking piece 98 formed on the upright restriction wall 28 neighboring thereto, the mounting notch 114 formed in the protruded wall portion 106 of the engaging member 92 is brought in match with the support shaft 96 formed on the upright restriction wall 28, and the engaging member 92 is moved rearwards. Thus, the support shaft 96 is inserted in the mounting notch 114 of the engaging member 92; i.e., the engaging member 92 is pivotably mounted on the support shaft 96. Then, a resilient urging means 120 which may be a compression coil spring is interposed between the receiving piece 100 formed on the upright restriction wall 28 and the right surface of the main wall portion 104 of the engaging member 92. As clearly shown in FIG. 4, the resilient urging means 120 resiliently urges the engaging member 92 in the counterclockwise direction as viewed from the front side, so that the engaging portion 110 formed at the lower end of the main wall portion 104 of the engaging member 92 is brought into engagement with the to-be-engaged portion 118 of the stationary to-be-engaged means 94. The engaging portion 110 of the engaging member 92 is brought into engagement with the to-be-engaged portion 118 of the stationary to-be-engaged means 94, and is reliably prevented from moving in the back-and-forth direction. Therefore, the front width restriction means 22 is reliably prevented from moving in the back-and-forth direction. As will be understood from FIG. 4, the engaging member 92 is reliably prevented from leftwardly moving substantially perpendicularly to the support shaft 96 since the main wall portion 104 of the engaging member 92 is locked by the locking piece 98. Accordingly, the engaging member 92 is reliably prevented from moving in a direction substantially perpendicularly to the support shaft 96 and does not escape from the support shaft 96. In a state in which the engaging portion 110 of the engaging member 92 is brought into engagement with the to-be-engaged portion 118 of the stationary to-be-engaged means 94, the to-be-locked protrusion 112 of the engaging member 92 is positioned in the insertion notch 102 of locking wall 98 formed on the upright restriction wall 28 and, hence, the engaging member 92 is reliably prevented from forwardly moving and does not escape from the support shaft 96. When it is desired to change the position of the front width restriction means 22 in the back-and-forth direction, the finger-touch surface 108 of the engaging member 92 is touched by a finger, and the engaging member 92 is slightly turned in the clockwise direction as viewed from the front side against the resilient urging action of the resilient urging means 120. The engaging portion 110 of the engaging member 92 is then separated from the to-be-engaged portion 118 of the stationary to-be-engaged means 94 to discontinue the action of the locking mechanism 90. In this state, the front width restriction means 22 is allowed to be moved in the back-and-forth direction.

Attention should be given to the following facts concerning the above-mentioned locking mechanism 90 in the cassette 2 for feeding sheet materials. First, since the engaging member 92 does not have the so-called under-cut, it can be made of a suitable synthetic resin by the injection molding or the compression molding without using a relatively complex mold having a slide core or a slide pin. That is, the engaging member 92 can be molded using a simple mold very cheaply. Second, the engaging member 92 can be mounted to the support shaft 96 easily and quickly through the above-mentioned simple operation without the need of using screws or a mounting fitting.

Figure 6:
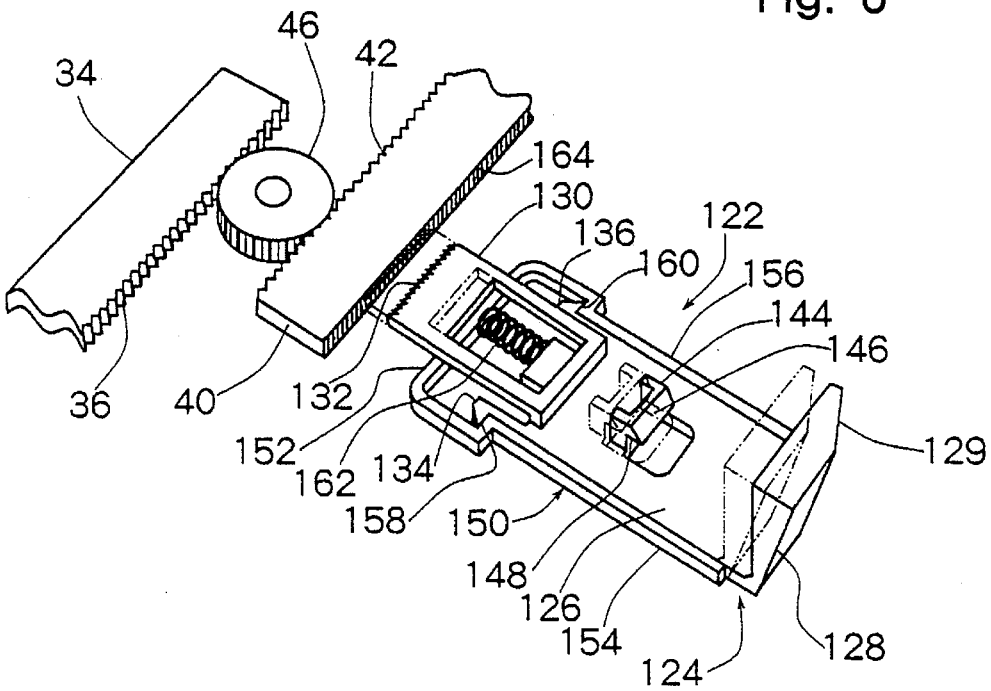
FIG. 6 is a perspective view illustrating a portion of the locking mechanism that is provided in relation to a rear width restriction means in the cassette for feeding sheet materials shown in FIG. 1.
Figure 7:
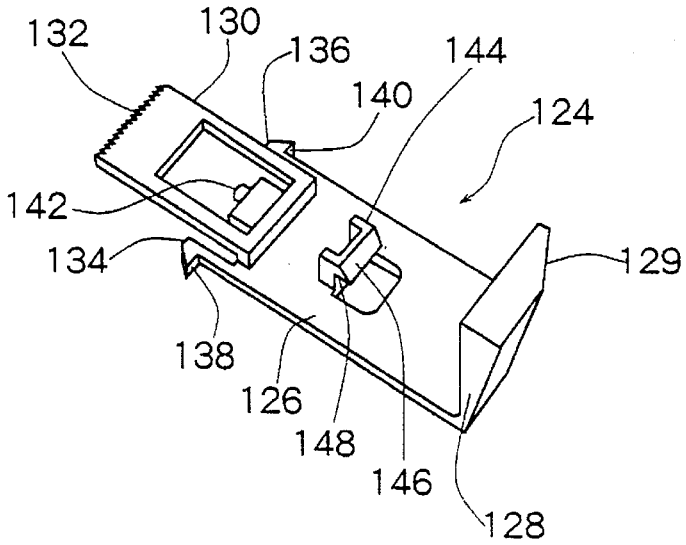
FIG. 7 is a perspective view illustrating a locking member in the locking mechanism shown in FIG. 6.

With reference to FIGS. 1 to 3 as well as FIGS. 6 and 7, it is important that the image-forming machine improved according to the present invention is provided with a locking mechanism 122 in relation to the rear width restriction means 24. The locking mechanism 122 includes a locking member 124. As clearly shown in FIG. 7, the locking member 124 that can be made of a suitable synthetic resin has a base plate 126 that extends substantially horizontally and a receiving portion 128 that upwardly extends from the right end of the base plate 126. The thickness of the receiving portion 128 gradually increases upwards. At the rear end on the upper part of the receiving portion 128 is formed a tilted surface 129 that is gradually tilted rearwardly and leftwardly. On the upper surface of the base plate 126 is formed a protruded piece 130 that extends leftwardly. On the protruded end surface of the protruded piece 130 is formed an engaging portion 132 constituted by a plurality of grooves and protrusions that are alternately arranged. On the base plate 126 are further formed engaging arms 134 and 136 that leftwardly protrude from the front end and the rear end thereof. An engaging protrusion that defines an engaging surface 138 is formed at the front left end of the engaging arm 134, and an engaging protrusion that defines an engaging surface 140 is formed at the rear left end of the engaging arm 136. A protuberance 142 is formed on the left end surface of the base plate 126. A placing plate-locking piece 144 is formed at an intermediate portion of the base plate 126 in the right-and-left direction. The placing plate-locking piece 144 upwardly protrudes from the upper surface of the base plate 126, and has at the right end thereof a tilted introduction surface 146 that is rightwardly tilted downwards and an engaging surface 148 that leftwardly extends substantially horizontally from the lower end of the tilted introduction surface 146. As shown in FIG. 6, furthermore, a mount/guide portion 150 is formed at the right end on the upper surface of the bottom wall member 20. The mount/guide portion 150 is constituted by a protrusion having a contact portion 152 that extends in the back-and-forth direction and further having guide portions 154 and 156 that rightwardly extend from the front end and the rear end of this portion 152. The guide portions 154 and 156 have engaging shoulder surfaces 158 and 160 that are faced rightwards.

With reference to FIGS. 6 and 7, the locking member 124 has its base plate 126 located between the guide portions 154 and 156 of the mount/guide portion 150, and is mounted to move in the right-and-left direction. A resilient urging means 162 which is preferably a compression coil spring is interposed between the base plate 126 of the locking member 124 and the contact portion 152 of the mount/guide portion 150. One end of the resilient urging means 162 is contacted to the contact portion 152 of the mount/guide portion 150 and its other end is engaged with a protrusion 142 formed on the left surface thereof. The resilient urging member 162 resiliently urges the locking member 124 to the release position indicated by solid lines in FIGS. 2 and 6. At the release position, the engaging surfaces 138 and 140 of engaging arms 134 and 136 of the locking member 124 are brought into contact with the engaging shoulder surfaces 158 and 160 formed in the guide portions 154 and 156 of the mount/guide portion 150, so that the locking member 124 is limited from moving rightwards. An opening is formed in the right surface of the container body 4 to correspond to the receiving portion 128 of the locking member 124, and the receiving portion 128 of the locking member 124 rightwardly protrudes through this opening.

Figure 8:
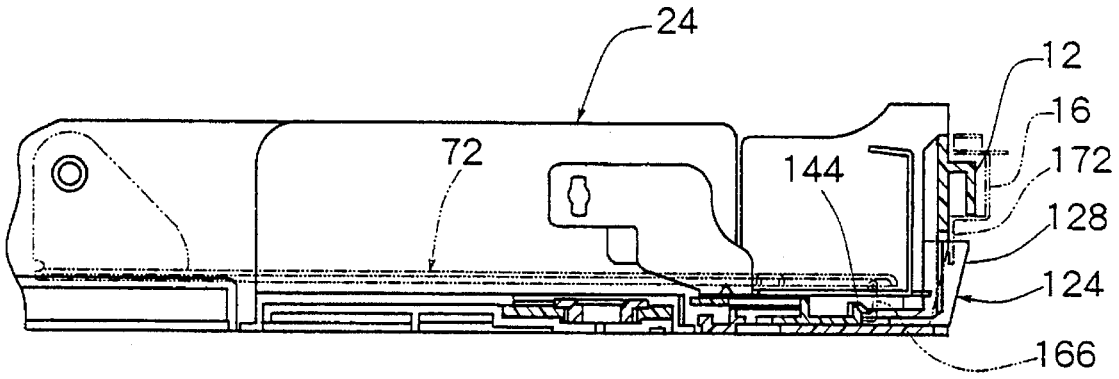
FIG. 8 is a sectional view illustrating a portion of the cassette for feeding sheet materials shown in FIG. 1.

As clearly shown in FIG. 6, the protruded piece 130 of the locking member 124 is positioned being opposed to the pinion gear 46 with the extended portion 40 of the rear width restriction means 24 being interposed therebetween. On the right surface of extruded portion 40 of the rear width restriction means 24 is formed a to-be-engaged portion 164 constituted by many grooves and protrusions that are alternately arranged. When the locking member 124 is located at the above-mentioned release position, the engaging portion 132 formed on the protruded piece 130 of the locking member 124 is separated from the to-be-engaged portion 164 formed on the extended portion 40 of the rear width restriction means 24. With reference to FIG. 8, on the lower surface of the placing plate 72 is formed an L-shaped to-be-locked piece 166 correspondingly to the placing plate-locking piece 144 formed on the locking member 124. When the right end of the placing plate 72 is lowered against the urging action of the resilient urging means 84 that upwardly urges the right end of the placing plate 72, the to-be-locked piece 166 of the placing plate 72 acts on the tilted introduction surface 146 of placing plate-locking piece 144, whereby the locking member 124 is slightly moved leftwards against the urging action of the resilient urging means 162. As the to-be-locked piece 166 of the placing plate 72 passes over the tilted introduction surface 146, the locking member 124 is returned back to the initial release position due to the urging action of the resilient urging means 162, and the to-be-locked piece 166 of the placing plate 72 is brought into engagement with the engaging surface 148 of the placing plate-locking piece 144. Thus, the placing plate 72 is locked at a descended position shown in FIG. 8.

With reference to FIG. 1, a forcing means 168 that acts on the locking member 124 is disposed in the housing 10 of the image-forming machine. The forcing means 168 in the illustrated embodiment is constituted by a pushing piece that is formed integrally with the stationary guide rail 16 disposed in the housing 10. The pushing piece that rearwardly runs from the intermediate portion of the stationary guide rail 16 as viewed in the back-and-forth direction, has a tilted front portion 170 that rearwardly extends being tilted leftwards and a main portion 172 that is continuous thereto and rearwardly extends without being tilted.

When the cassette 2 for feeding sheet materials is located at the drawn position that is drawn forward in the housing 10, the locking member 124 of the locking mechanism 122 is located at the release position indicated by a solid line in FIGS. 6 and 8 due to the urging action of the resilient urging means 162. As the cassette 2 for feeding sheet materials is rearwardly moved toward the acting position in the housing 10, the tilted front portion 170 of the forcing means 168 starts interfering with the receiving portion 128 of the locking member 124, whereby the locking member 124 gradually moves leftwards in FIG. 8 overcoming the urging action of the resilient urging means 162. Interference between the forcing means 168 and the receiving portion 128 of the locking member 124 is started by the cooperation of the tilted front portion 170 and the tilted surface 129; i.e., interference starts very smoothly. As the cassette 2 for feeding sheet materials is rearwardly moved up to a predetermined position, the main portion 172 of the forcing means 168 interferes with the locking member 124 which is then moved to the locking position indicated by a two-dot chain line shown in FIGS. 6 and 8. The locking member 124 is maintained at the locked position while the cassette 2 for feeding sheet materials is located at the acting position in the housing 10. When the locking member 124 is brought to the locking position, the locking member 124 itself is resiliently deformed to some extent due to the forcing action of the forcing means 168, and the protruded piece 130 is resiliently pushed onto the extended portion 40 of the rear width restriction means 24. Thus, the engaging portion 132 formed at the protruded end of the protruded piece 130 is brought into engagement with the to-be-engaged portion 164 formed on the extended portion 40 of the rear width restriction means 24. Accordingly, the rear width restriction means 24 is prevented from moving in the back-and-forth direction. As the protruded piece 130 of the locking member 124 is pushed onto the extended portion 40 of the rear width restriction means 24, furthermore, the rack 42 formed in the extended portion 40 is pushed onto the pinion gear 46. That is, since there no longer exists the so-called play that is inevitably present between the rack 42 and the pinion gear 46, the rack 42 and the pinion gear 46 are very reliably prevented from moving relative to each other. Thus, the rear width restriction means 24 is prevented from moving in the back-and-forth direction, and the front width restriction means 22 is also prevented from moving in the back-and-forth direction, too.

As is easily understood by comparison between FIG. 3 and FIG. 8, when the locking member 124 is moved to the locking position from the release position overcoming the action of the resilient urging means 162, the to-be-locked piece 166 of the placing plate 72 is liberated from the engaging surface 148 of the placing plate-locking piece 144 formed on the locking member 124, whereby the placing plate 72 and the right end of the sheet material placed thereon are upwardly and resiliently urged by the action of the resilient urging means 84.

When the cassette 2 for feeding sheet materials is drawn to the drawn position, the receiving portion 128 of the locking member 124 is separated away from the forcing means 168, and the locking member 124 is returned back to the release position by the urging action of the resilient urging means 162.

In the above-mentioned embodiment, the locking mechanism 122 of a particular form is provided in relation to the rear width restriction means 24. As desired, however, the locking mechanism 122 of the particular form may be provided in relation to the front width restriction means 22 instead of, or in addition to, the locking mechanism 122 of the particular form provided in relation to the rear width restriction means 24. It is further allowable to provide the rear end restriction means 60 with a locking mechanism of a constitution substantially the same as the locking mechanism 122. In the cassette 2 for feeding sheet materials of the so-called front-loading type which moves in the back-and-forth direction between the acting position and the drawn position in the housing 10, however, relatively large impact is not given to the rear end restriction means 60. In this case, therefore, any particular trouble does not arise on the locking mechanism in relation to the rear end restriction means 60 and the rear end restriction means 60 can be provided with a cheaply constructed locking mechanism having an operation piece 70 and the like members that are integrally formed with the upright restriction wall 68 as shown in the illustrated embodiment.

In the image-forming machine constituted according to the present invention, when the cassette for feeding sheet materials is brought to the drawn position, the locking member is urged to the release position due to the urging action of the resilient urging means, whereby the locking action of the locking member is liberated, and the front width restriction means and the rear width restriction means can be moved as required in the back-and-forth direction very easily. When the cassette for feeding sheet materials is moved toward the acting position from the drawn position beyond a predetermined position, the locking member is forced to the locking position due to the action of the forcing means, and the front width restriction means and the rear width restriction means are very reliably prevented from moving in the back-and-forth direction.

What we claim is:

1. An image-forming machine comprising a housing and a cassette for feeding sheet materials which is loaded in said housing so as to move in the back-and-forth direction between an acting position and a drawn position that is forwardly drawn from said acting position in said housing, wherein said cassette for feeding sheet materials includes a container body, a front width restriction means and a rear width restriction means which are so disposed in said container body as to move in the back-and-forth direction, said front width restriction means has a bottom wall with a rearwardly extended portion and an upright restriction wall that upwardly extends from the bottom wall, said rear width restriction means has a bottom wall with a forwardly extended portion and an upright restriction wall that upwardly extends from the bottom wall, said container body has a rotary pinion gear that is disposed between said extended portion of said front width restriction means and said extended portion of said rear width restriction means that extend in parallel with each other, and racks that are brought into engagement with said pinion gear are engraved in said extended portion of said front width restriction means and in said extended portion of said rear width restriction means, characterized in that said image-forming machine further comprises a locking mechanism which includes a locking member and a first resilient urging means that are disposed in said container body of said cassette for feeding sheet materials and a forcing means disposed in said housing, and in that said locking member is disposed to move between a locking position at which it is brought into engagement with either said extended portion of said front width restriction means or said extended portion of said rear width restriction means and a release position at which it is liberated from both said extended portion of said front width restriction means and said extended portion of said rear width restriction means, said first resilient urging means resiliently urges said locking member to the release position, and when said cassette for feeding sheet materials is rearwardly moved from said drawn position toward said acting position beyond a predetermined position, said forcing means acts upon said locking member to force said locking member to said locking position, overcoming said first resilient urging means.

2. An image-forming machine according to claim 1, wherein a to-be-engaged portion is formed on said extended portion of said rear width restriction means and an engaging portion is formed on said locking member so as to be brought into engagement with said to-be-engaged portion.

3. An image-forming machine according to claim 1, wherein said locking member is made of a synthetic resin and, when said forcing means acts on said locking member to force said locking member to said locking position, said locking member is resiliently brought into engagement with either said extended portion of said front width restriction means or said extended portion of said rear width restriction means due to the resilient deformation of said locking member itself.

4. An image-forming machine according to claim 1, wherein said locking member is disposed being opposed to said pinion gear via either said extended portion of said front width restriction means or said extended portion of said rear width restriction means and when said locking member is forced to said locking position, said rack formed in either said extended portion of said front width restriction means or said extended portion of said rear width restriction means is pushed onto said pinion gear.

5. An image-forming machine according to claim 1, wherein said cassette for feeding sheet materials further includes a placing plate that is pivotably mounted in said container body and a second resilient urging means which upwardly and resiliently urges a tip portion of said placing plate, and wherein said locking member has a placing plate-locking piece, said placing plate has a to-be-locked piece and when the tip portion of said placing plate is lowered against the urging action of said second resilient urging means while the locking member is located at said release position, said to-be-locked piece of said placing plate is brought into engagement with said placing plate-piece of said locking member so that the tip portion of said placing plate is locked at a descended position and when said locking member is forced to said locking position, said to-be-locked piece of said placing plate is liberated from said placing plate-locking piece.

* * * * *